US008559643B2

(12) United States Patent
Akino et al.

(10) Patent No.: US 8,559,643 B2
(45) Date of Patent: Oct. 15, 2013

(54) STEREO MICROPHONE UNIT AND STEREO MICROPHONE

(75) Inventors: Hiroshi Akino, Tokyo (JP); Satoshi Yoshino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 346 days.

(21) Appl. No.: 12/881,887

(22) Filed: Sep. 14, 2010

(65) Prior Publication Data

US 2011/0103594 A1 May 5, 2011

(30) Foreign Application Priority Data

Sep. 15, 2009 (JP) ..... 2009-212741

(51) Int. Cl.
*H04R 3/00* (2006.01)
*H04R 9/08* (2006.01)

(52) U.S. Cl.
USPC ..... 381/26; 381/111; 381/113; 381/122; 381/356

(58) Field of Classification Search
USPC ..... 381/91, 92, 122, 174, 191, 111, 113, 381/356
See application file for complete search history.

(56) References Cited

U.S. PATENT DOCUMENTS

| | | | | |
|---|---|---|---|---|
| 4,329,547 | A * | 5/1982 | Imai | 381/163 |
| 4,491,697 | A * | 1/1985 | Tanaka et al. | 381/113 |
| 6,985,597 | B2 * | 1/2006 | Akino | 381/174 |

FOREIGN PATENT DOCUMENTS

| | | |
|---|---|---|
| JP | 6-35597 | 9/1994 |
| JP | 2002-374592 | 12/2002 |
| JP | 2908-227779 | 9/2008 |

* cited by examiner

*Primary Examiner* — Vivian Chin
*Assistant Examiner* — Ammar Hamid
(74) *Attorney, Agent, or Firm* — Witham Curtis Christofferson & Cook, PC

(57) ABSTRACT

A stereo capacitor microphone unit includes: two unidirectional microphone units integrally formed with respective fixed electrodes of the unidirectional microphone units facing each other; and an insulating spacer that is interposed between the fixed electrodes and provided with a gap formed at a portion of an outer periphery towards radial direction. The gap communicates fixed electrode rear spaces of the respective unidirectional microphone units with an external space to serve as a common rear acoustic terminal for the unidirectional microphone units.

6 Claims, 7 Drawing Sheets

STEREO MICROPHONE UNIT AND STEREO MICROPHONE

BACKGROUND OF THE INVENTION

1. Field of the Invention

The present invention relates to a stereo microphone unit and a stereo microphone, and more particularly, the invention relates to a stereo microphone unit that can have a smaller size compared with conventional counterparts and a stereo microphone including the same.

2. Description of the Related Art

An XY stereo system and an MS stereo system are known as sound pickup systems of a stereo microphone. In the XY stereo system, two unidirectional microphone units are fixed to form an appropriate angle. The microphone unit directed to the left outputs L channel signal and microphone unit directed to the right outputs R channel signal. The appropriate angle is, for example, 120 degrees (see, for example Japanese Utility Model Application Publication H6-35597).

In the MS stereo system, a unidirectional microphone unit and a bidirectional microphone unit are used. A main signal M obtained from the unidirectional microphone unit and a directional signal S obtained from the bidirectional microphone unit directed to a direction orthogonal to that of the unidirectional microphone unit are fed to a matrix circuit to generate (M+S) and (M−S) signals. For example, the (M+S) signal is an L channel signal and the (M−S) signal is an R channel signal (see for example, Japanese Patent Application Publication 2002-374592).

FIG. 5 illustrates an example of a stereo microphone employing the XY stereo system. In FIG. 5, a stereo capacitor microphone unit 100 includes a pair of left (L) channel side unidirectional microphone unit 100L and right (R) channel side unidirectional microphone unit 100R. In FIG. 5, components other than the pair of unidirectional microphone units 100L and 100R on the left and the right side, respectively, are omitted.

As illustrated in FIG. 5, the XY stereo system has a more simple circuit configuration compared with that for the MS stereo system and thus is mainly employed in a low-cost stereo microphone In the XY stereo system, the stereo capacitor microphone units 100L and 100R need to be fixed with their respective directional axes DL and DR forming an appropriate angle. Therefore, a holder that holds the microphone units in an appropriate angular relationship is required. In addition, to make the range of the stereo sound variable, a mechanism is required with which the angle between the directional axes DL and DR can be changed.

Generally, two microphone units in the XY stereo system are incorporated in a single head case (windshield). Such a head case is required to have a large size and a special shape to fix the two microphone units in an appropriate angular relationship.

A stereo microphone unit is known that can solve the above problems and allows an XY stereo microphone to be formed with small number of components and small size (see, for example Japanese Patent Application Publication 2008-227779). Here, two general-purpose unidirectional microphone units are fixed with their main axes forming 180 degrees. A sound insulating cover is provided over a space serving as a rear acoustic terminal between respective fixed electrodes of the left and right microphone units. Directional axes for sound pickup can be adjusted by shifting the position of the rear acoustic terminal.

An example of a stereo microphone unit disclosed in Japanese Patent Application Publication 2008-227779 is illustrated in FIG. 6. As illustrated in FIG. 6, this stereo microphone unit 200 includes: general-purpose unidirectional capacitor microphone units 200L, and 200R being fixed with their respective main axes forming 180 degrees; and a sound insulating cover 201 provided over a space formed between respective fixed electrodes of units 200L and 200R. A position offset from the main axes by the sound insulating cover 201 is a rear acoustic terminal RT. Accordingly, the stereo microphone unit has directionality capable of performing stereo sound pickup with the directional axes DL and DR forming a certain angle as illustrated in FIG. 6.

In such a stereo microphone unit disclosed in Japanese Patent Application Publication 2008-227779, an air chamber is inevitably formed between the two units (left and right) and the insulating cover. The air chamber serves not only as a rear acoustic terminal but also as a common resonator for respective rear acoustic terminals of left and right units. Therefore directional collapse occurs due to deterioration of acoustic characteristics in high frequency range and deterioration of S/N ratio.

Exemplary frequency characteristics of the stereo microphone unit 200 illustrated in FIG. 6 are depicted in FIG. 7. In FIG. 7, the horizontal axis represents frequency of a signal emitted from a sound source, and the vertical axis represents a gain in the stereo microphone unit 200. FIG. 7 depicts the L channel signal of the stereo microphone unit 200. A graph a in FIG. 7 represents a case where the sound source is at the front side in the main axis of the stereo capacitor microphone unit 200L, that is, at the diaphragm side on the main axis of the stereo capacitor microphone unit 200L (see FIG. 6). A graph b in FIG. 7 represents a case where the sound source is at the position offset by 90 degrees from the main axis of the stereo microphone unit 200, that is, at the sound insulating cover 201 side. A graph c in FIG. 7 represents a case where the sound source is at the rear side in the main axis of the stereo capacitor microphone unit 200L, that is, at the stereo capacitor microphone unit 200R side. A graph d represents a case where the sound source is at the rear acoustic terminal RT.

As depicted in FIG. 7, the stereo sound pickup is possible for a signal with frequency lower than 5 kHz because the gain in the front side in the main axis (graph a) and other gains with different sound source directions is different and sounds from left and right can be distinguished and picked up.

On the other hand, with a signal with frequency not lower than 5 kHz, resonance due to the air chamber occurs to provide a substantially omnidirectional state. When this happens, sounds from left and right cannot be distinguished, and thus, stereo sound pickup is impossible.

Such resonation can be prevented by providing an acoustic resistor in the air chamber. Unfortunately, provision of such an acoustic resistor, which has a certain amount of thickness, limits the downsizing of the stereo capacitor microphone unit as a whole.

In addition, the stereo capacitor microphone unit is likely to be affected by wind noise because each of the left and the right units has acoustic terminals respectively at the front and the back thereof. Accordingly, the stereo capacitor microphone unit needs to be improved in this point as well.

SUMMARY OF THE INVENTION

The present invention is made in view of the above problems. An object of the present invention is to provide a stereo microphone unit in which two unidirectional capacitor microphone units fixed via an insulating spacer with their main axes forming 180 degrees share a single rear acoustic terminal. In the configuration, resonation is prevented from occurring and influence of wind noise is small unlike the conventional counterpart. Furthermore, the stereo microphone unit can be formed with a smaller number of components and can have a smaller size. The invention also pertains to a stereo microphone using such a stereo microphone unit.

In accordance with an aspect of the present invention, a stereo capacitor microphone unit includes: two unidirectional microphone units integrally formed with respective fixed electrodes of the unidirectional microphone units facing each other; and an insulating spacer that is interposed between the fixed electrodes and provided with a gap formed at a portion of an outer periphery towards a radial direction. The gap communicates fixed electrode rear spaces of the respective unidirectional microphone units with an external space to serve as a common rear acoustic terminal for the unidirectional microphone units.

In the above described stereo capacitor microphone unit, the gap is preferably formed at a portion around a midpoint in thickness direction of the insulating spacer with a certain length from the periphery of the insulating spacer towards a center of the insulating spacer.

In the above described stereo capacitor microphone unit, an acoustic resistor is preferably provided in the gap.

In the above described stereo capacitor microphone unit, a directional axis of each of the unidirectional microphone units is preferably offset by a certain angle from a main axis of each of the unidirectional microphone units.

In the above described stereo capacitor microphone unit, a directional axis of each of the unidirectional microphone units is offset by a certain angle from a main axis of the each of the unidirectional microphone units, and the directional axes of the unidirectional microphone units form an angle of 120 degrees at a midpoint of a main axis of the stereo capacitor microphone unit.

In accordance with another aspect of the present invention, a stereo capacitor microphone includes: a microphone, casing; and a stereo capacitor microphone unit incorporated in the microphone casing. The stereo capacitor microphone unit is the above described stereo capacitor microphone unit.

According to the present invention, the two unidirectional capacitor microphone units are fixed facing opposite directions with their main axes forming 180 degrees, the insulating spacer is provided between the rear surface sides of the fixed electrodes of respective microphone units and the gap formed at a middle portion of the insulating spacer communicates the rear air chambers of the respective fixed electrodes of the microphone units to the external space. Therefore, the two capacitor microphone units can share the single rear acoustic terminal. Accordingly, the stereo microphone unit can be obtained that has smaller size and less components as well as higher frequency characteristic by preventing the resonation from occurring and lowering the influence of sound noise, which were the problems in conventional counterparts, and the stereo microphone using such a stereo microphone unit can also be obtained.

DETAILED DESCRIPTION OF THE PREFERRED EMBODIMENTS

Figure 1:
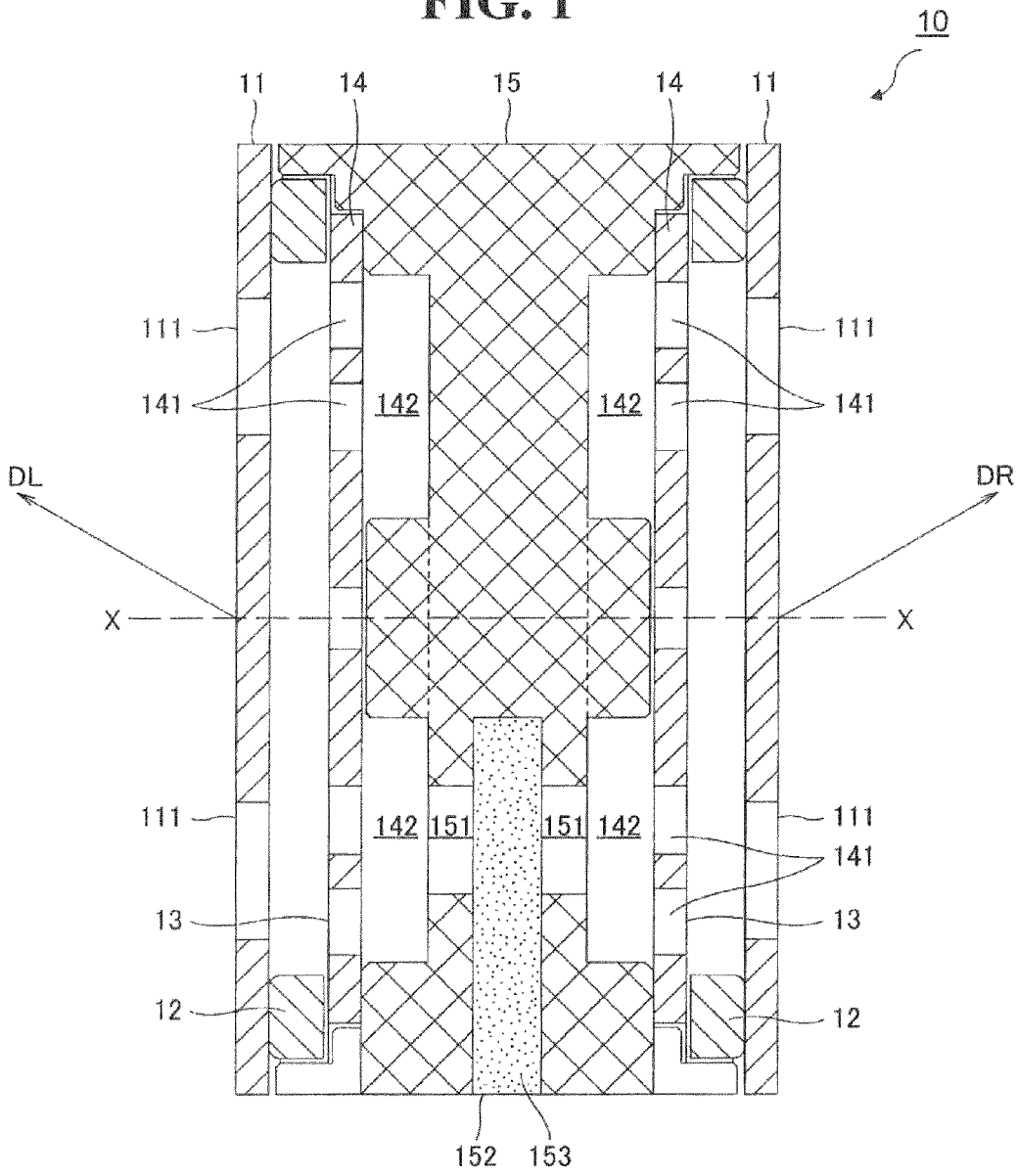
FIG. 1 is a cross-sectional view of an embodiment of a stereo capacitor microphone unit according to the present invention.

An embodiment of a stereo capacitor microphone unit according to the present invention is described below with reference to some of the accompanying drawings. FIG. 1 is a cross-sectional view of a stereo capacitor microphone unit according to an embodiment of the present invention. A stereo capacitor microphone according to the present embodiment includes a stereo capacitor microphone unit 10 illustrated in FIG. 1. As illustrated in FIG. 1, in the stereo capacitor microphone unit 10, two unidirectional capacitor microphone units are respectively provided at the right side and the left side of an insulating spacer 15 and the insulating spacer 15 is disposed in the center. Each of the unidirectional microphone units includes a fixed electrode 14, a spacer (not illustrated), and a diaphragm ring 12 provided with a diaphragm 13 in a stretched state. The elements of each of the unidirectional microphones are positioned by being sandwiched between a fixing plate 11 and the insulating spacer 15.

The insulating spacer 15 has a circular shape with a diameter larger than that of the diaphragm ring 12.

Figure 2:
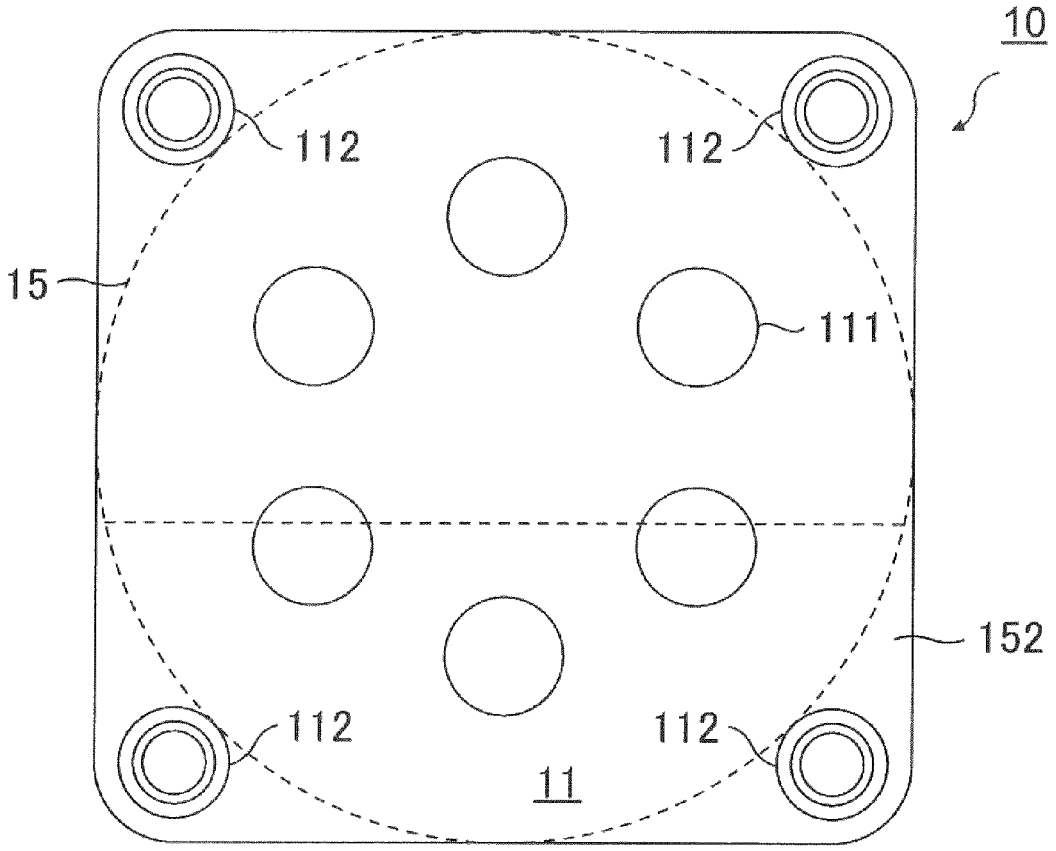
FIG. 2 is a side view of the embodiment of the stereo capacitor microphone unit according to the present invention.

FIG. 2 is a side view of the stereo capacitor microphone unit 10. As illustrated in FIG. 2, the stereo capacitor microphone unit 10 has a substantially rectangle form. The fixing plates 11, which are substantially rectangular plates, are each provided with holes through which fixtures 112 penetrate at the four corners. The above described elements are fixed at the positions with the insulating spacer 15 disposed in the center, by fixing the fixing plates 11 with the fixtures 112.

The fixtures 112 such as screws are inserted in respective holes in one of the fixing plates 11 and are screwed into respective screw holes in the other fixing plate 11 or into respective screw nuts provided at the holes in the other fixing plate 11 and corresponding to the fixtures 112. Thus, inward pressing force is applied by the fixtures 112 inserted from right and left. With such a force, the diaphragm rings 12, the diaphragms 13, the spacer rings (not illustrated), and the fixed electrodes 14 are fixed with a certain positional relationship with the insulating spacer 15. Multiple holes formed around the center of the fixing plate 11 serves as front acoustic terminal holes 111. The front acoustic terminal holes 111 are covered with a mesh material such as a wire mesh to prevent foreign objects such as dust from entering therethrough.

The dotted line slightly below the center line of the fixing plate 11 illustrated in FIG. 2 represents an end portion of a later described gap provided on the insulating spacer 15.

Returning to FIG. 1, the diaphragm 13 may be a thin synthetic resin film having metal deposition film and the fixed electrode 14 is a metallic plate made of, for example, aluminum. Alternatively, the diaphragm 13 of a film electret type is made of an electret film, and the electret film is integrally attached to the fixed electrode 14 in a back electret system.

A circuit board (not illustrated) is disposed outside the stereo capacitor microphone unit 10. The circuit board is provided with a field-effect transistor (FET) serving as an impedance converter. The gate terminal of the FET is electrically connected to the fixed electrode 14 via an intermediate electrode (not illustrated).

A part of the insulating spacer 15 is cut away from an outer peripheral towards the inner diameter direction to form a gap 152. More specifically, the gap 152 is formed by cutting away the insulating spacer 15 at the mid point in the width direction (horizontal direction as viewed in FIG. 1) and from the outer peripheral portion towards the center for a certain amount.

The gap 152 includes rear air chambers 142 at portions between the insulating spacer 15 and the fixed electrode 14 and a communication hole 151 that communicates the rear air chambers 142 with the external space. Furthermore, influence of wind noise can be reduced by providing an acoustic resister 153 made of a wire body or nonwoven fabric in the gap 152.

A sound wave from a sound source (not illustrated) entering the stereo capacitor microphone unit 10 having the above structure directly from the front acts on the front side of the diaphragm 13 via the front acoustic terminal 111. A sound wave from the sound source entering the stereo capacitor microphone unit 10 from the gap 152 acts on the rear side of the diaphragm 13 via the communication hole 151 and the rear air chamber 142 of the fixed electrode 14.

As illustrated in FIG. 1, directional axes DL and DR each form a certain angle between the main axis X passing the center of the diaphragms 13 respectively at the left and the right sides, where the directional axis DL is the left directional axis of the stereo capacitor microphone unit 10 and the directional axis DR is the right directional axis of the stereo capacitor microphone unit 10. This is because the position of the rear acoustic terminal is shifted from the main axis X due to the gap 152. The angle of the directional axis X of the stereo capacitor microphone unit is preferably 120 degrees. The angle formed between the directional axis DL (DR) and the main axis X depends on the thickness and the depth of the gap 152. Therefore, the angle of the directional axis X of the stereo capacitor microphone unit can be set to 120 degrees by adjusting the size of the gap 152.

Figure 3:
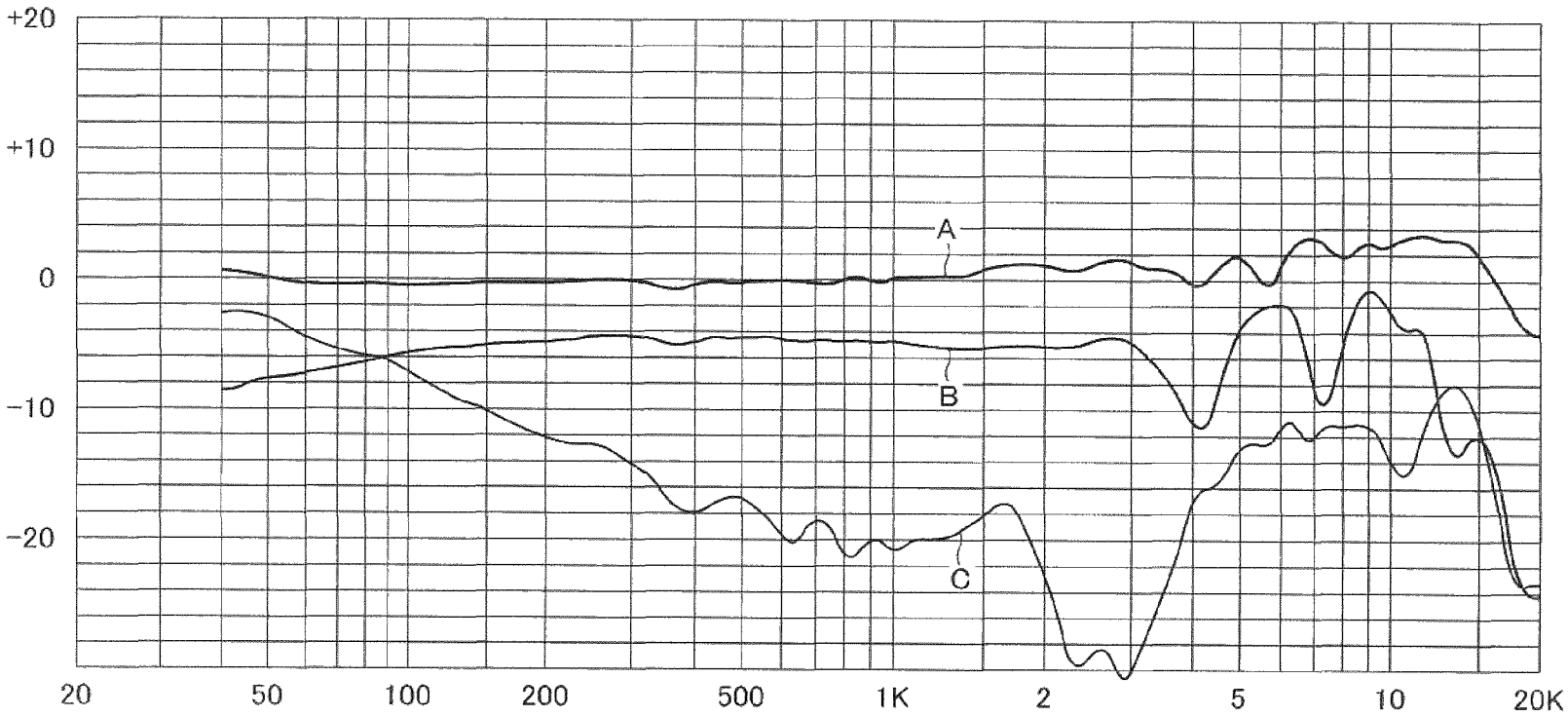
FIG. 3 is a graph depicting exemplary frequency characteristics of the stereo capacitor microphone unit according to the present invention.

FIG. 3 is a graph depicting exemplary frequency characteristics of the stereo capacitor microphone unit 10 according to the embodiment of the present invention. Specifically, FIG. 3 depicts output levels of the stereo capacitor microphone unit 10 corresponding to signals of various frequencies emitted from a sound source. The frequency characteristic of one of the two unidirectional capacitor microphone units forming the stereo capacitor microphone unit 10 is depicted in FIG. 3. In FIG. 3, the horizontal axis represents the frequency of a signal emitted from the sound source and the vertical axis represents gain in the measured unidirectional capacitor microphone unit. A graph A in FIG. 3 represents the case where the sound source is placed on the front side in the main axis X of the microphone unit. A graph B in FIG. 3 represents the case where the sound source is placed at a position offset by 90 degrees from the main axis X and is at a portion on the upper side as viewed in FIG. 1. A graph C in FIG. 3 represents the case where the sound source is placed on the rear side in the main axis X of the measured unidirectional capacitor microphone unit. capacitor microphone unit.

As illustrated in FIG. 3, even when the frequency of the signal from the sound source is at and above 5 kHz, the frequency characteristic curves of the output of the each of the capacitor microphone units facing the left and the right sides (the graphs a and c) are separated. Accordingly, the stereo capacitor microphone unit 10 according to the embodiment of the present invention can perform stereo sound pickup without degradation in directionality due to resonance.

Figure 4:
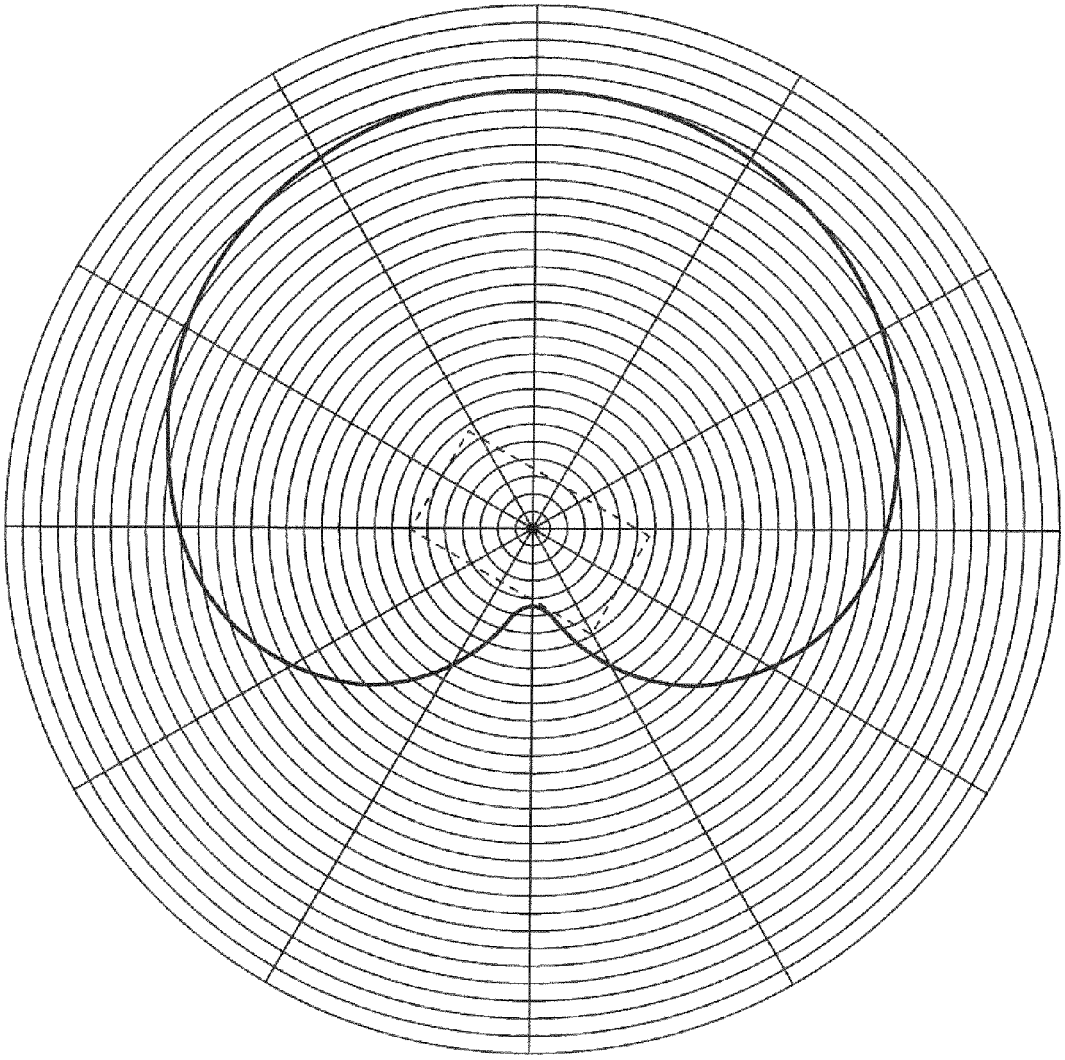
FIG. 4 is a diagram depicting exemplary directionality of the stereo capacitor microphone unit according to the present invention.
Figure 5:
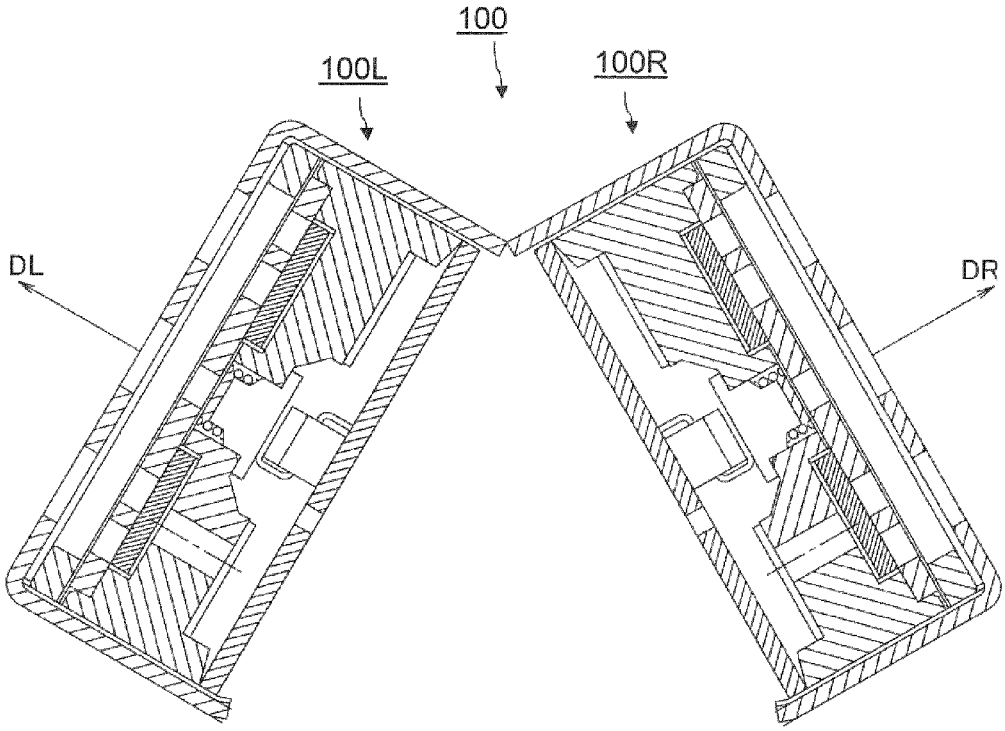
RELATED ART FIG. 5
FIG. 5 is a cross-sectional view of an example of a conventional stereo capacitor microphone unit.
Figure 6:
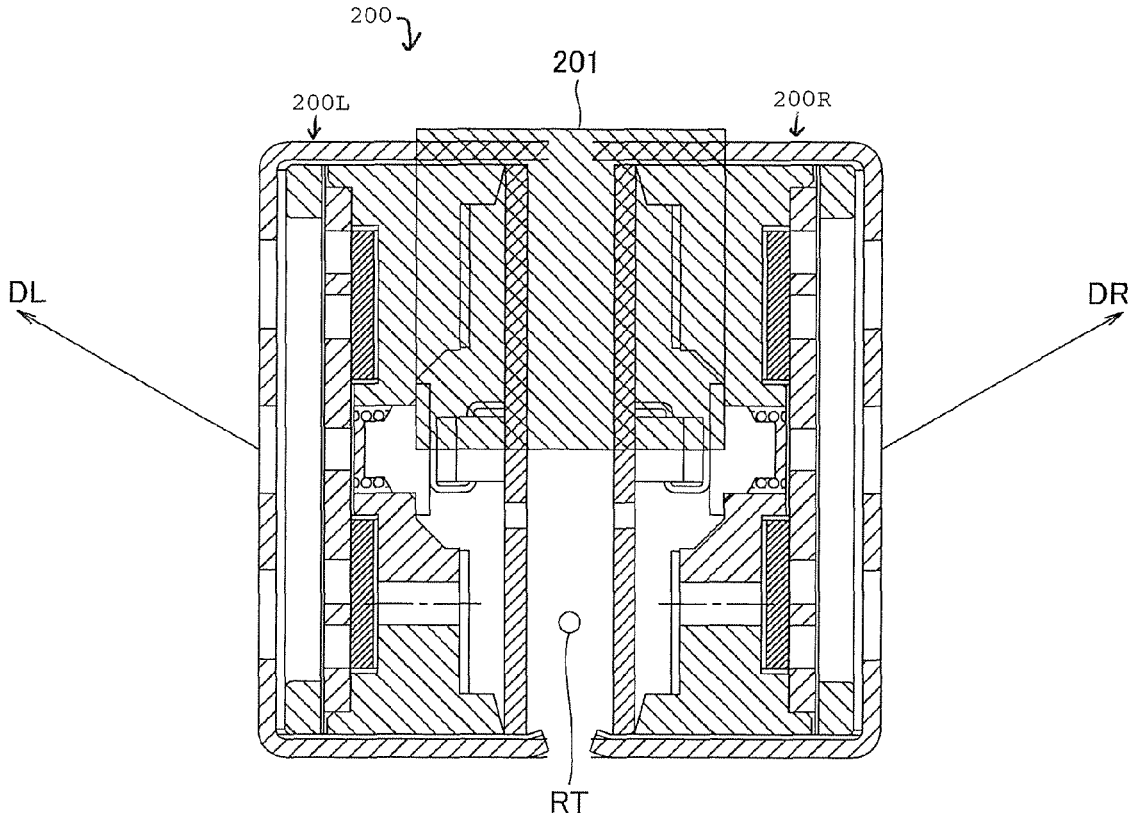
RELATED ART FIG. 6
FIG. 6 is a cross-sectional view of another example of a conventional stereo capacitor microphone unit.
Figure 7:
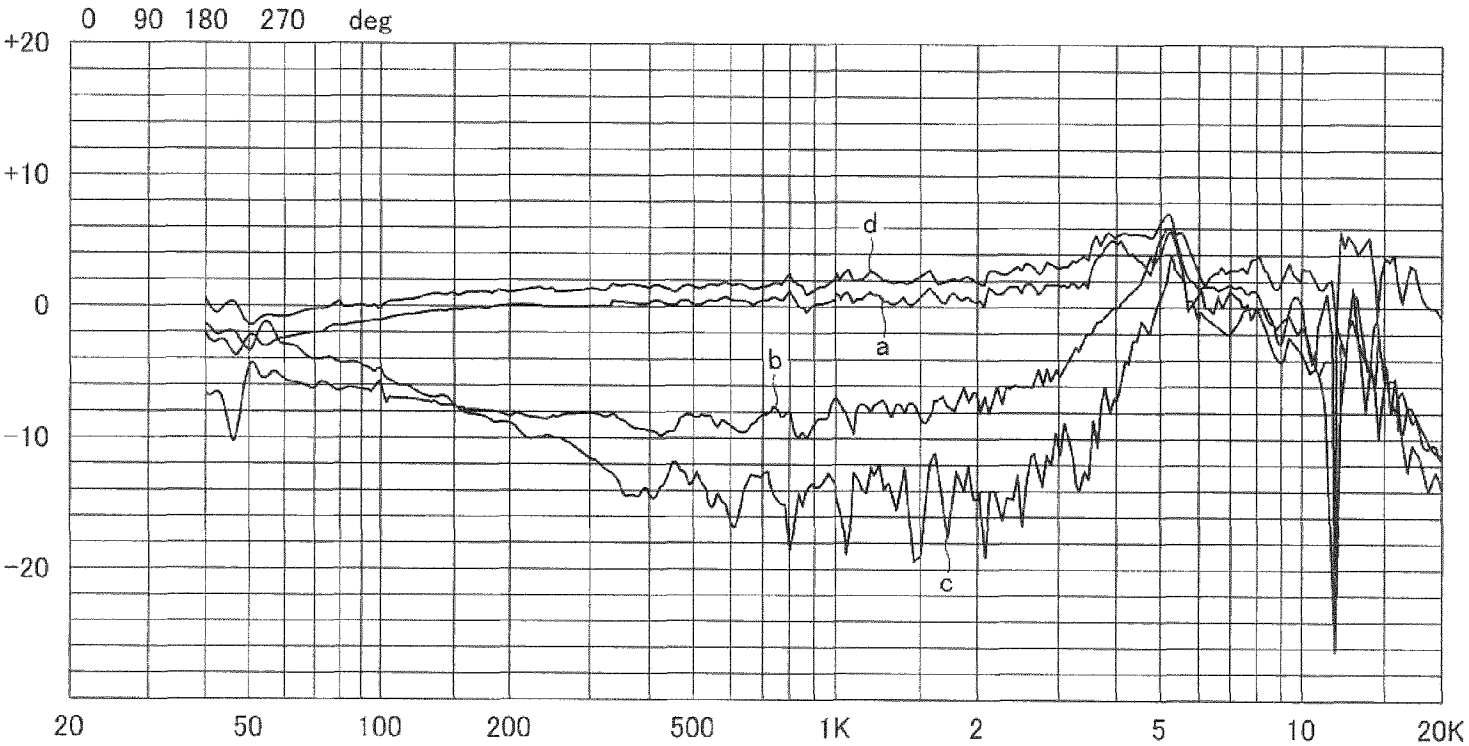
RELATED ART FIG. 7
FIG. 7 is a graph depicting exemplary frequency characteristics of the conventional stereo capacitor microphone unit.

The stereo capacitor microphone unit 10 has directionality capable of performing stereo sound pickup as illustrated by the directional curve in FIG. 4.

As described above, the left and the right unidirectional capacitor microphone units share the rear acoustic terminal formed by the gap 152. The directional axes DL and DR of the left and the right unidirectional capacitor microphone units, respectively, can be offset by a certain angle from the main axis X according to the size of the gap 152. Thus, the stereo capacitor microphone unit capable of performing stereo sound pickup can be obtained.

In the stereo capacitor microphone unit 10 according to the embodiment of the present invention, no resonance occurs due to the air chamber because the space serving as the rear acoustic terminal is extremely small. Therefore, excellent stereo sound pickup over large-bandwidth can be achieved without degradation in S/N ratio in the high frequency range. In addition, dramatic downsizing is possible because the two unidirectional capacitor microphone units share a single rear acoustic terminal.

Generally, two unidirectional capacitor microphone units have a total of four acoustic terminals, i.e., one each on the left and the right side of each of the two unidirectional capacitor microphone units. The number of acoustic terminals can be reduced by sharing the rear acoustic terminal, thereby reducing wind noise.

A stereo capacitor microphone can be obtained by incorporating the stereo capacitor microphone unit according to the present invention in a microphone casing.

What is claimed is:

1. A stereo capacitor microphone unit comprising:

two unidirectional microphone units integrally formed with respective fixed electrodes of the unidirectional microphone units facing each other; and an insulating spacer that is interposed between the fixed electrodes and provided with a gap formed at a portion of an outer periphery extending towards a center of the insulating spacer, wherein the gap communicates fixed electrode rear spaces of the respective unidirectional microphone units with an external space to serve as a common rear acoustic terminal for the unidirectional microphone units.

2. The stereo capacitor microphone unit according to claim 1, wherein the gap is formed at a portion around a midpoint in a thickness direction of the insulating spacer with a certain length from the periphery of the insulating spacer towards said center of the insulating spacer which is less then a distance from said periphery to said center of the insulating spacer.

3. The stereo capacitor microphone unit according to claim 1, wherein an acoustic resistor is provided in the gap.

4. The stereo capacitor microphone unit according to claim 1, wherein a directional axis of each of the unidirectional microphone units is offset by a certain angle from a main axis of each of the unidirectional microphone units.

5. A stereo capacitor microphone comprising:

a microphone casing; and a stereo capacitor microphone unit incorporated in the microphone casing, wherein the stereo capacitor microphone unit is the stereo capacitor microphone unit according to claim 1.

6. A stereo capacitor microphone unit comprising:

two unidirectional microphone units integrally formed with respective fixed electrodes of the unidirectional microphone units facing each other; and an insulating spacer that is interposed between the fixed electrodes and provided with a gap formed at a portion of an outer periphery towards radial direction, wherein the gap communicates fixed electrode rear spaces of the respective unidirectional microphone units with an external space to serve as a common rear acoustic terminal for the unidirectional microphone units, and wherein a directional axis of each of the unidirectional microphone units is offset by a certain angle from a main axis of the each of the unidirectional microphone units, and the directional axes of the unidirectional microphone units foam an angle of 120 degrees at a midpoint of a main axis of the stereo capacitor microphone unit.

* * * * *

UNITED STATES PATENT AND TRADEMARK OFFICE

CERTIFICATE OF CORRECTION

PATENT NO. : 8,559,643 B2
APPLICATION NO. : 12/881887
DATED : October 15, 2013
INVENTOR(S) : Akino et al.

It is certified that error appears in the above-identified patent and that said Letters Patent is hereby corrected as shown below:

In the Claims:

Claim 6, Col. 7, line 12, delete "foam" and insert -- form --.

Signed and Sealed this
Twenty-eighth Day of January, 2014

Michelle K. Lee

Michelle K. Lee
*Deputy Director of the United States Patent and Trademark Office*